US006979245B1

(12) United States Patent
Goodwin

(10) Patent No.: US 6,979,245 B1
(45) Date of Patent: Dec. 27, 2005

(54) PUZZLE APPARATUS WITH AUDIBLE SOUNDS

(75) Inventor: Richard P. Goodwin, Bristol, TN (US)

(73) Assignee: Fenwick Enterprises, LLC, Piney Flats, TN (US)

( * ) Notice: Subject to any disclaimer, the term of this patent is extended or adjusted under 35 U.S.C. 154(b) by 63 days.

(21) Appl. No.: 10/863,108

(22) Filed: Jun. 8, 2004

(51) Int. Cl.[7] ..... A63M 33/38

(52) U.S. Cl. ..... 446/149; 446/138; 446/175; 446/397; 273/153 S

(58) Field of Search ..... 446/397, 135, 446/137, 138, 484, 81, 147, 149, 151, 175; 40/124.04, 124.03; 273/153 R, 156, 157 R, 273/153 S

(56) References Cited

U.S. PATENT DOCUMENTS 4,323,243 A * 4/1982 Hanson et al. ..... 273/153 S
4,493,487 A * 1/1985 Ferrigni ..... 273/153 S
4,796,891 A * 1/1989 Milner ..... 273/153 S
5,087,043 A * 2/1992 Billings et al. ..... 273/157 R
5,267,732 A * 12/1993 Bowen et al. ..... 273/153 S
5,529,301 A * 6/1996 Feller ..... 273/153 S
2002/0111203 A1 * 8/2002 Chi ..... 463/9

FOREIGN PATENT DOCUMENTS

WO WO 9311840 A1 * 6/1993 ..... A63F 9/08

* cited by examiner

*Primary Examiner*—Bena Miller
(74) *Attorney, Agent, or Firm*—G. Brian Pingel; Camille L. Urban

(57) ABSTRACT

A puzzle apparatus comprising a first plurality of puzzle pieces that form a picture when combined together that includes a representation of at least one cartoon character, a magnet associated with at least one of the puzzle pieces, a platform on which the puzzle pieces can be arranged, a detector for sensing the magnet and sound generating apparatus for producing audible sounds corresponding to the character shown on the puzzle pieces.

20 Claims, 5 Drawing Sheets

PUZZLE APPARATUS WITH AUDIBLE SOUNDS

BACKGROUND OF THE INVENTION

1. Field of the Invention

The present invention relates in general to a puzzle apparatus that includes a number of puzzles that can each be arranged, one-at-a-time, on a platform of a housing and more specifically involves the use of sound producing means associated with the platform for producing audible sounds representative of characters shown on each of the puzzles.

2. Description of the Prior Art

A variety of different types of puzzles are known in the prior art which serve to provide an intellectually challenging test of a user's skill in being able to arrange puzzle pieces together to form a completed picture. As an improvement over such prior art devices, the present invention provides a means for producing a variety of sayings that are associated with characters shown in puzzles such as well-known cartoon characters. Thus, once the puzzle pieces of a puzzle have been properly arranged on the platform, the user can select and activate a sound producing assembly that will provide an audible saying associated with one of the characters shown on the puzzle.

SUMMARY OF THE INVENTION

The present invention provides a puzzle apparatus having at least a first plurality of puzzle pieces that form a picture that includes a representation of at least a first audible sound producing means, detectible means associated with at least one of the puzzle pieces, a platform on which the puzzle pieces can be arranged, detection means associated with the platform for sensing the detectible means and a sound means for producing audible sounds that are related to the various sound producing representations that may be shown in the puzzle picture.

In a preferred embodiment, the apparatus includes a housing having a top surface that included the platform on which the puzzle pieces can be arranged and the sound means includes a plurality of actuators that can be engaged as desired by a user to produce a variety of audible sounds that are associated with representations of characters or other types of sound producing means that are shown on the picture produced by the puzzle pieces. Preferably, each picture formed by the puzzle pieces includes a plurality of representations of characters or other audible sound producing means and the sound means is designed to allow a user to select the playing of audible sounds that form a story or other material that is expressed in the voices of the characters depicted.

The apparatus is designed to include a variety of different puzzle pieces to form multiple pictures, each with different representations of characters on them. The puzzle pieces for each picture include detectible means that differ from picture-to-picture to differentiate one picture from the other and the housing platform includes a detection means that is able to sense the detectible means on each picture and provide an output representative of the particular picture that is arranged on the platform. The housing further includes a plurality of actuators that are each associated with one of the characters shown in the picture. Thus, when one of the actuators is engaged by a user, the apparatus will provide an audible saying of the actuator's associated character shown on the particular picture then located on the platform.

The foregoing and other advantages of the present invention will appear from the following description. In the description, reference is made to the accompanying drawings, which form a part hereof, and in which there is shown by illustration and not of limitation a specific form in which the invention may be embodied. Such embodiment does not represent the full scope of the invention, but rather the invention may be employed in a variety of other embodiments and reference is made to the claims herein for interpreting the breadth of the invention.

DETAILED DESCRIPTION OF THE PREFERRED EMBODIMENT

Figure 1:
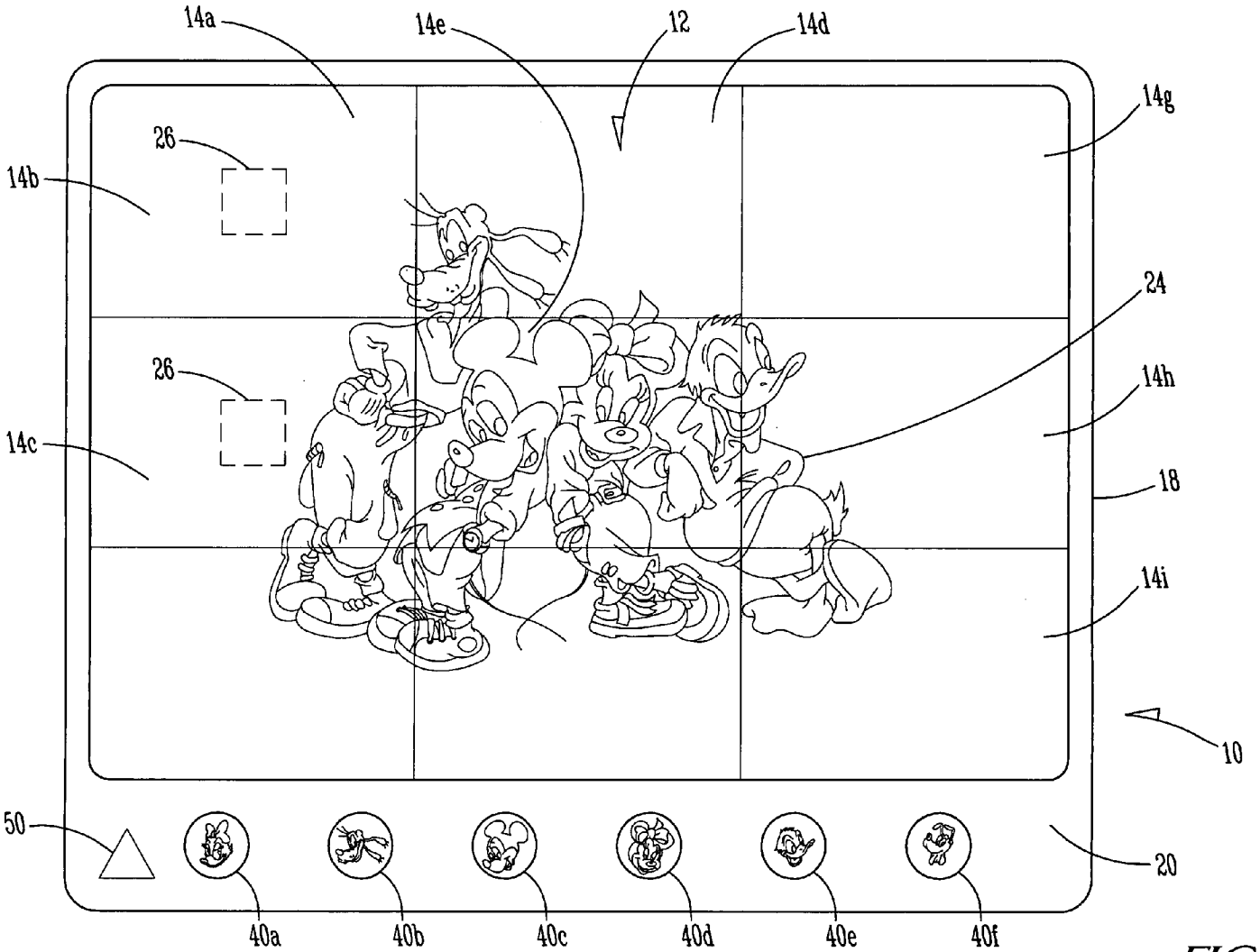
FIG. 1 is a plan view of a preferred embodiment of the puzzle apparatus of the present invention that includes a plurality of puzzle pieces that form a picture.

The following description is provided with reference to the drawings beginning first with FIG. 1 in which a preferred embodiment of a puzzle apparatus of the present invention is shown generally at 10 and is designed to provide not only an enjoyable and challenging experience for young children, but also serves as an entertainment device for them. The apparatus 10 is designed to include a plurality of puzzles such as a puzzle 12 as shown that is formed from a plurality of puzzle pieces 14*a–i*.

Figure 3:
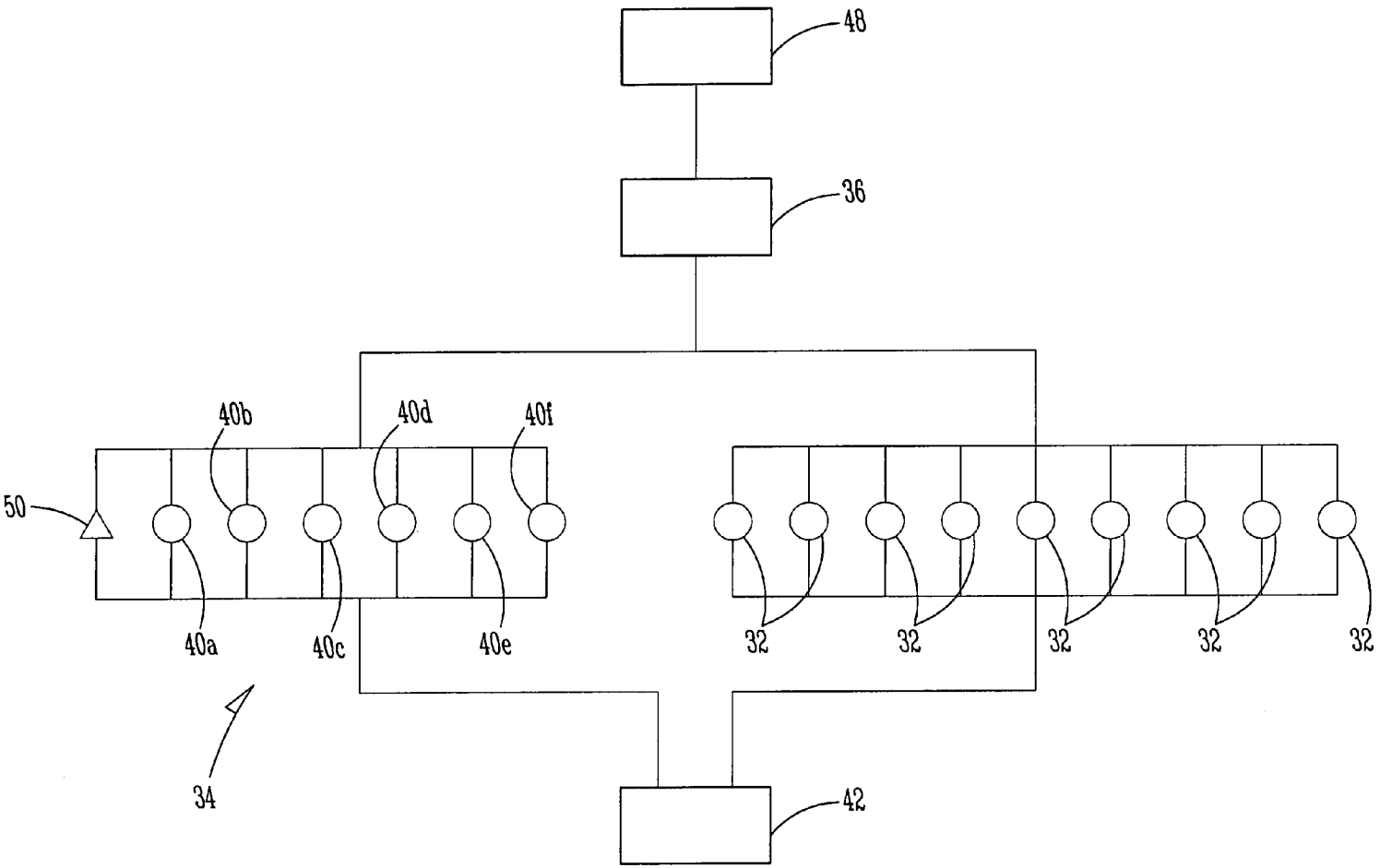
FIG. 3 is a block diagram of the electronic circuitry useable in the embodiment of FIG. 1.
Figure 4:
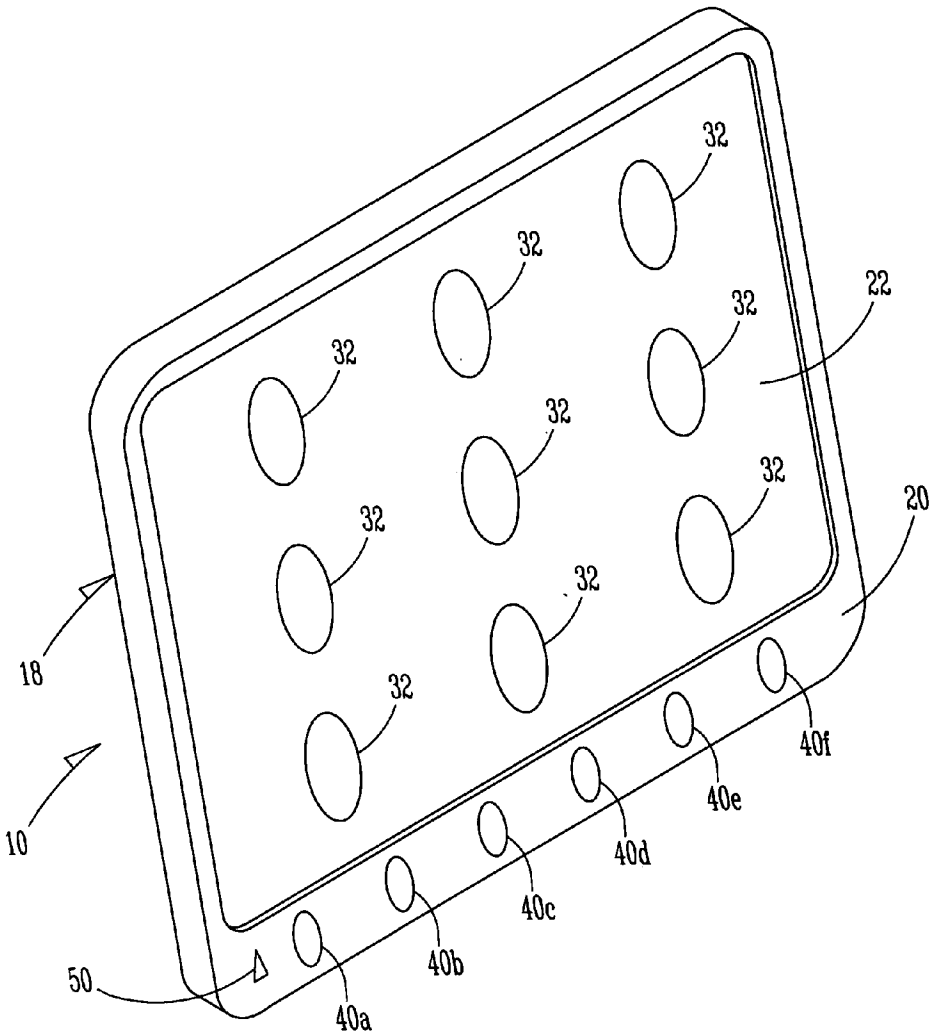
FIG. 4 is a side perspective view similar to that of FIG. 2.
Figure 5:
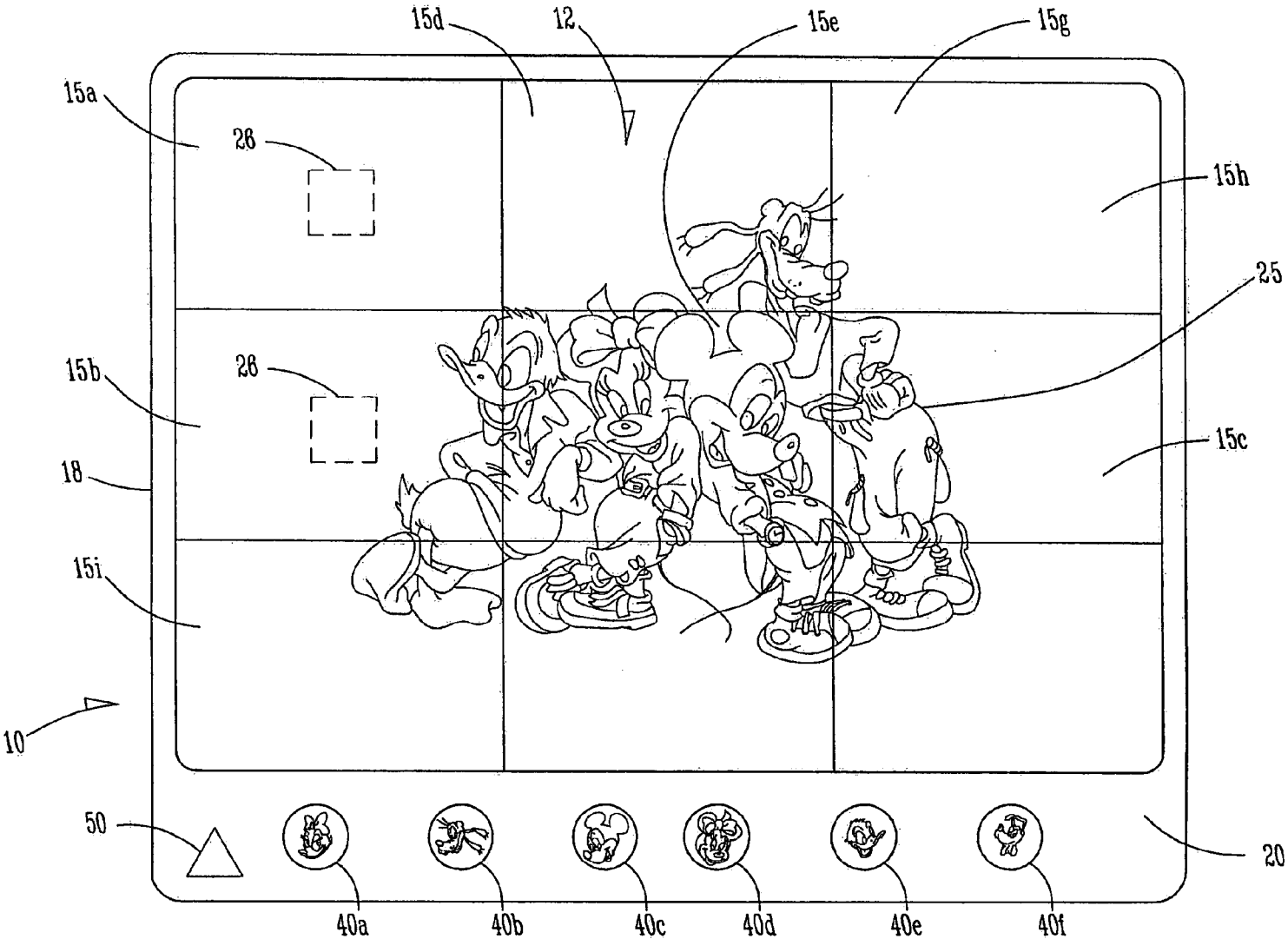
FIG. 5 is a plan view of a the preferred embodiment of FIG. 1 that includes a second plurality of puzzle pieces.

Referring now to FIGS. 1, 3 and 4, the apparatus 10 includes a relatively thin rectangularly shaped housing 18 having a top surface 20 with a recessed platform portion 22 in which the puzzle pieces 14*a–i* are to be arranged to form a picture 24, serving as a visual representation. Except for the particular section of the picture 24 they each contain, the puzzle pieces 14*c–i* are essentially the same. However, the puzzle pieces 14*a* and *b* differ from the remainder of the puzzle pieces 14*c–i* in that they each include preferably an embedded magnetic strip 26 that serves as a detectible element by detecting means of the housing 18. As can be seen in FIG. 5, the apparatus 10 may include a second plurality of puzzle pieces 15*a–i* arranged to form a second picture 25.

Figure 2:
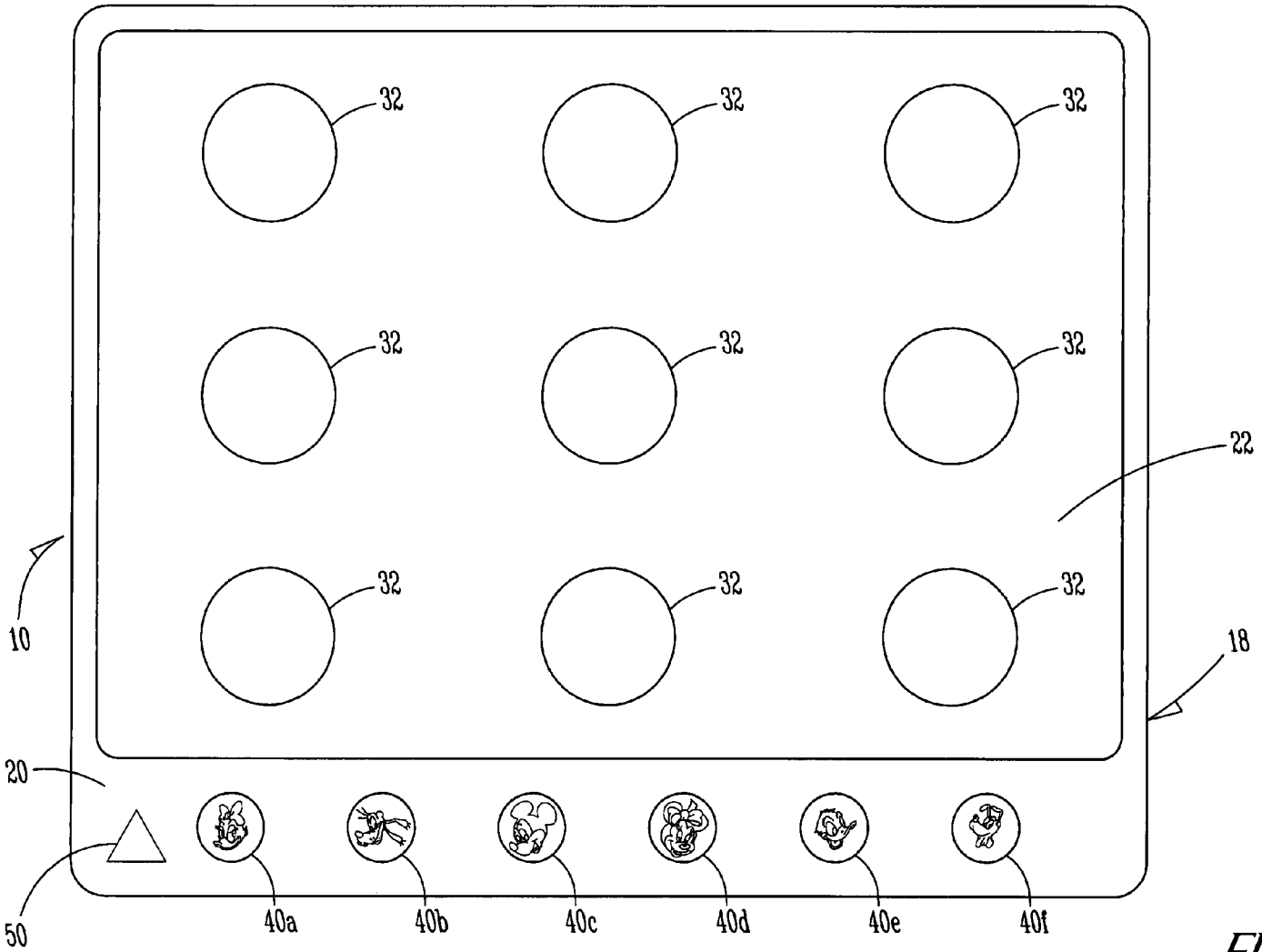
FIG. 2 is a plan view similar to that of FIG. 1, but with the puzzle pieces removed therefrom.

The detecting means is formed of preferably, a plurality of magnetic sensors 32 shown in FIGS. 2 and 4 that are located in the platform portion 22 and are included as part of an electronic circuit 34, as shown in FIG. 3 that is contained within the housing 18. Thus, when the puzzle pieces 14*a–i* are arranged together on the platform portion 22, the magnetic sensors 32 detect the magnetic strips 26 in the puzzle pieces 14*a* and *b* and provide output signals in response to such detection to a printed circuit 36 that preferably includes a central processing unit 38 (not shown).

Upon sensing of the magnetic strips 26 in the puzzle pieces 14*a* and *b* by the sensors 32, the CPU 38 is programmed to recognize that the puzzle 12 is arranged on the platform portion 22. Similarly, other puzzles that are used with the apparatus 10 will have puzzle pieces in which the magnetic strips 26 are contained in, but the magnetic strips in such puzzles will be located in different puzzle pieces than those of the puzzle 12. In this way, the apparatus 10 is able to discern the particular type of puzzle that is arranged in the platform portion 22. However, it should be recognized by those skilled in the art that there are other methods that could be used for differentiating between the puzzles rather than through the use of the magnetic strips 26. For example, a bar code and a bar code reader could be utilized.

Referring again to FIG. 1, the picture 24 includes a representation of four audible sound producing means in the form of the cartoon characters, Goofy, Mickey Mouse, Minnie Mouse and Donald Duck. Directly beneath the platform portion 22 are six longitudinally aligned actuator buttons 40*a–f* that are preferably pressure or touch sensitive and contain a depiction of the head of a cartoon character, with the buttons 40*b–e* having the heads of the cartoon characters shown in the picture 24.

The electronic circuit 34 is preferably powered by battery power supply 42 as shown in FIG. 3 and is designed so that when one of the actuator buttons 40*b–e* is pressed by a user, a voice chip 44 (not shown) in the printed circuit 36 will produce electronic signals representative of a saying by the cartoon character depicted on the button pressed, which signals are provided to a speaker 48 that audibly reproduces such signals. Preferably, the saying that is rendered will be related to the activity of the characters that is shown in the picture 24 and may well consist of a story. Thus, pressing of the actuator buttons 40*b–e* one-at-a-time produces a saying by each one of the cartoon characters shown in the picture 24. Alternatively, rather than having the characters depicted on the buttons 40*a–f* provide a narration, the housing 18 includes a triangular shaped master button 50 that, when pushed provides a complete narration of the material that would otherwise be rendered.

Because the cartoon characters depicted on the buttons 40*a* and *f* are not included in the picture 24, preferably such characters will not have a saying associated with them for the picture 24. However, it is envisioned that other puzzles to be used with the apparatus 10 will include a different selection of the cartoon characters depicted on the actuator buttons 40*a–f*, and will show the cartoon characters involved in different activities so that the voice chip 44 will produce different sayings from those produced for the puzzle 12. Furthermore, the use of cartoon characters is not critical to the present invention as any audible sound producing means may be depicted on the puzzle 12 such as animals or musical instruments, etc. Additionally, the apparatus 10 can be adapted to include other sets of characters and associated puzzles simply through the use of covers that can be placed on the actuator buttons 40*a–f*. Such covers would include the depiction of the puzzle characters rather than the buttons 40*a–f*. Also the CPU 38 would have to be programmed to recognize two or more different sets of puzzles with different characters or the apparatus could employ replaceable cartridges that would be used for the various puzzle sets.

Thus, the present invention provides a novel and unique means for supplying a user with the challenge of having to properly put a puzzle together and then supplies an entertaining version of a description of the activity involved on a picture contained on a puzzle. Although the puzzle apparatus of the present invention has been described with respect to a preferred embodiment, it should be understood that such embodiment may be altered without avoiding the true spirit and scope of the present invention. For example, a wide variety of electronic circuitry can be substituted for the circuitry 34 and the puzzles employed with the apparatus 10 may contain a large plurality of different types of characters, musical instruments, machines or other types of audible sound producing means.

What is claimed is:

1. A puzzle apparatus comprising:

(a) a first plurality of removable puzzle pieces that form a first picture when properly combined together that includes at least one visual representation associated with at least one audible sound producing means;

(b) at least a first detectible means associated with at least one of said puzzle pieces;

(c) a platform having a surface on which said puzzle pieces can be arranged and said at least one audible sound producing means;

(d) detection means associated with said platform and adapted for sensing said at least one detectible means, and providing a first output signal that is representative of said first plurality of puzzle pieces; and (e) means actuable by a user for receiving said first output signal and activating said at least one sound producing means to produce a first audible sound associated with said at least one visual representation.

2. The puzzle apparatus as described in claim 1, wherein said apparatus further comprises:

(a) a second plurality of puzzle pieces that form a second picture when properly combined together that includes at least one visual representation associated with at least a second audible sound producing means;

(b) at least a second detectible means associated with at least one of said second plurality of puzzle pieces;

(c) said detection means is associated with said platform and is adapted for sensing said second detectible means and providing a second output signal that is representative of said second plurality of puzzle pieces; and (d) said sound means when actuated by a user is adapted for receiving said second output signal and activating said second audible sound producing means for producing a second audible sound associated with said at least one visual representation of said second picture.

3. The puzzle apparatus as described in claim 2, wherein said first and second plurality of puzzle pieces respectively include a plurality of said detectible means.

4. The puzzle apparatus as described in claim 3, wherein said apparatus can sense the particular puzzle arranged on said platform and will provide different audible sounds for each of said puzzles.

5. The puzzle apparatus as described in claim 4, wherein said sound means comprises:

(a) a plurality of actuators designed to be individually actuated by a user as desired;

(b) electronic circuitry for producing output signals corresponding to said audible sound producing means; and (c) means for receiving said electronic signals and producing audible sounds corresponding to such signals.

6. The puzzle apparatus as described in claim 5, wherein said first and second plurality of puzzle pieces each include a plurality of visual representations associated with said audible sound producing means and said sound means is adapted to produce specific audible sounds associated with each of said visual representations.

7. The puzzle apparatus as described in claim 6, wherein said detection means is adapted to provide output signals to said sound means to indicate the type of puzzle arranged on said platform.

8. The puzzle apparatus as described in claim 6, wherein each of said actuators is associated with one of the plurality of representations of said audible sound producing means so that when a particular one of said actuators is activated by a user, the sound means will produce the specified audible sounds representative of said audible sound producing means.

9. The puzzle apparatus as described in claim 8, wherein said actuators are in the form of buttons that each have a symbol thereon that is related to one of the representations associated with said audible sound producing means.

10. The puzzle apparatus as described in claim 9, wherein each of said actuator buttons has a cover on which said symbol is contained so that a plurality of different puzzles can be used with said apparatus, which puzzles can include different representations associated with audible sound producing means.

11. The puzzle apparatus as described in claim 2, wherein each of said first and second pictures contain a plurality of visual representations associated with a plurality of audible sound producing means.

12. The puzzle apparatus as described in claim 2, wherein said platform is part of a housing in which electronic circuitry for said apparatus is contained.

13. The puzzle apparatus as described in claim 1, wherein said first picture includes a visual representation associated with a plurality of audible sound producing means and said sound means includes a plurality of actuating means.

14. The puzzle apparatus as described in claim 13, wherein said sound means further includes a master actuator to be actuated by a user to produce audible sounds representative of all of said audible sound producing means.

15. The puzzle apparatus as described in claim 13, wherein said sound means further includes a master actuator to be actuated by a user to produce audible sounds representative of a story.

16. A puzzle apparatus comprising:

(a) a first plurality of puzzle pieces that form a first picture when properly combined together that includes a visual representation associated with at least one audible sound producing means, said sound producing means including;

i. a plurality of actuators designed to be individually actuated by a user as desired;

ii. electronic circuitry for producing output signals corresponding to said audible sound producing means;

iii. means for receiving said electronic signals and producing audible sounds corresponding to such signals;

(b) at least a first detectible means associated with at least one of said puzzle pieces;

(c) a platform having a surface on which said puzzle pieces can be arranged and said at least one sound producing means;

(d) detection means associated with said platform and adapted for sensing said at least one detectible means, and providing a first output signal that is representative of said first plurality of puzzle pieces; and (e) means actuable by a user for receiving said first output signal and activating said at least one sound producing means to produce a first audible sound associated with said at least one visual representation.

17. The puzzle apparatus as described in claim 16, wherein said apparatus further comprises:

(a) a second plurality of puzzle pieces that form a second picture when properly combined together that includes a visual representation associated with at least a second audible sound producing means;

(b) at least a second detectible means associated with at least one of said second plurality of puzzle pieces;

(c) said detection means is associated with said platform and is adapted for sensing said second detectible means and providing a second output signal that is representative of said second plurality of puzzle pieces;

(d) said sound means when actuated by a user is adapted for receiving said second output signal and activating said second audible sound producing means for producing a second audible sound associated with said at least one visual representation of said second picture; and (e) said first and second plurality of puzzle pieces respectively include a plurality of said detectible means and include a plurality of visual representations associated with said audible sound producing means and said sound producing means is adapted to produce specific audible sounds representative of each of visual representations.

18. The puzzle apparatus as described in claim 17, wherein said detection means is adapted to provide output signals to said sound means to indicate the type of puzzle arranged on said platform.

19. The puzzle apparatus as described in claim 18, wherein each of said actuators is associated with one of the plurality of representations associated with said audible sound producing means so that when a particular one of said actuators is activated by a user, the sound means will produce the specified audible sounds representative of said audible sound producing means.

20. The puzzle apparatus as described in claim 19, wherein said actuators are in the form of buttons that each have a symbol thereon that is related to one of the representations associated with said audible sound producing means, each of said actuator buttons has a cover on which said symbol is contained so that a plurality of different puzzles capable of different representations of audible producing means can be used with said apparatus.

* * * * *